US009828142B2

(12) United States Patent
Boumnso et al.

(10) Patent No.: US 9,828,142 B2
(45) Date of Patent: Nov. 28, 2017

(54) DEVICE FOR PACKAGING A VISCOUS PRODUCT, AND METHOD OF IMPLEMENTING SAME

(75) Inventors: Jerome Boumnso, Chatillon (FR); Xavier Sutty, Meudon (FR)

(73) Assignee: PUMPART SYSTEM, Meudon (FR)

( * ) Notice: Subject to any disclaimer, the term of this patent is extended or adjusted under 35 U.S.C. 154(b) by 771 days.

(21) Appl. No.: 14/110,223

(22) PCT Filed: Apr. 4, 2012

(86) PCT No.: PCT/FR2012/050731

§ 371 (c)(1),
(2), (4) Date: Oct. 7, 2013

(87) PCT Pub. No.: WO2012/136932

PCT Pub. Date: Oct. 11, 2012

(65) Prior Publication Data

US 2014/0020337 A1 Jan. 23, 2014

(30) Foreign Application Priority Data

Apr. 5, 2011 (FR) ..... 11 52923

(51) Int. Cl.
*B65D 35/14* (2006.01)
*B65D 83/00* (2006.01)

(52) U.S. Cl.
CPC ..... *B65D 35/14* (2013.01); *B65D 83/0055* (2013.01); *B65D 2231/001* (2013.01)

(58) Field of Classification Search
CPC ..... B65D 35/14; B65D 83/00; B05B 11/048
USPC ..... 53/471; 222/90–99
See application file for complete search history.

(56) References Cited

U.S. PATENT DOCUMENTS 2,777,612 A * 1/1957 Bensen ..... B65D 35/14 222/209
3,275,193 A * 9/1966 Barr ..... B65D 83/62 222/386.5
3,936,334 A * 2/1976 Kushida ..... B29C 53/50 156/203
4,865,224 A * 9/1989 Streck ..... B65D 83/0055 222/1
5,275,311 A * 1/1994 Piarrat ..... B65D 35/14 222/105
5,373,967 A * 12/1994 Grooms ..... B65D 83/0055 222/209

(Continued)

FOREIGN PATENT DOCUMENTS

DE 921 078 12/1954
FR 2 922 145 4/2009

(Continued)

OTHER PUBLICATIONS

International Search Report dated Jun. 4, 2012, corresponding to PCT/FR2012/050731.

*Primary Examiner* — Thanh Truong
*Assistant Examiner* — Dariush Seif
(74) *Attorney, Agent, or Firm* — IPSILON USA, LLP

(57) ABSTRACT

The outer container 1 presents a series of air-admission orifices in a zone 6. The skirt 12 of the inner pouch 8, between its line 11 of fastening to the outer container 1 and its open end 10, constitutes a valve for closing the series of orifices in the event of manual squeezing being applied on the outer container 1.

11 Claims, 1 Drawing Sheet

(56) References Cited

U.S. PATENT DOCUMENTS

| | | | | | |
|---|---|---|---|---|---|
| 5,416,303 | A | * | 5/1995 | Grooms | B29C 65/18 156/274.2 |
| 5,429,702 | A | * | 7/1995 | Grooms | B05B 11/0045 156/156 |
| 5,454,486 | A | * | 10/1995 | Mack | B05B 11/047 222/105 |
| 5,454,896 | A | * | 10/1995 | Harding | B29C 63/26 156/156 |
| 5,529,213 | A | * | 6/1996 | Mack | B05B 11/047 222/105 |
| 5,615,803 | A | * | 4/1997 | Hatakeyama | B65D 35/22 222/105 |
| 5,983,965 | A | * | 11/1999 | Patrick | A61J 9/001 141/114 |
| 6,126,975 | A | * | 10/2000 | Archibald | B65D 33/2533 383/103 |

FOREIGN PATENT DOCUMENTS

| | | |
|---|---|---|
| GB | 2 253 387 | 9/1992 |
| JP | 4019447 U | 2/1992 |
| JP | H078242 U | 2/1995 |
| JP | 2001-072147 | 3/2001 |
| WO | 93/14021 | 7/1993 |
| WO | 2004/028924 | 4/2004 |

* cited by examiner

DEVICE FOR PACKAGING A VISCOUS PRODUCT, AND METHOD OF IMPLEMENTING SAME

The invention relates to a device for packaging viscous substance, and for emptying by manual pumping, and to a method of preparing it.

It is known to make devices for packaging viscous substance that are for emptying by direct manual pumping. In general, such devices are made up of an elastically deformable outer container and an inner pouch that deforms progressively as the substance is dispensed.

In order to ensure that the pouch is put under pressure for the purpose of dispensing the substance, the operator manually squeezes the outer container. Some devices include an orifice in the outer container, which orifice is closed by a flap or a valve at the moment that the operator applies pressure, e.g. as in documents WO 93/14021, GB 2 253 387, JP 4-19447, or JP 2001-072 147.

Certain other devices have an orifice in the outer container that is closed by a finger of the operator, e.g. as in documents U.S. Pat. No. 2,777,612 or JP 1995-008 242.

Document WO 2004/028 924 describes a device having an orifice closed by a finger of the operator and presenting the feature of being suitable for emptying fully.

All of those devices can be polluted by liquids or powders penetrating into the outer container. The orifice is large enough to allow sand or grains to pass through, for example, and it is always accessible from the outside, even if it includes a valve. In devices having a valve, the valve is a separate fitting that can be difficult to be put into place and its mechanical retention may fail. Furthermore, devices having an orifice for closing by an operator's finger require the orifice and the operator's finger to be accurately located when the device is in use. Finally, the orifice is ugly in appearance and is perceived as a zone of vulnerability in the device.

One of the objects of the invention is to provide a device for packaging viscous substance, that remedies at least one of those drawbacks, avoiding pollution inside the outer container and avoiding the need to fit a separate valve.

The invention provides a device for packaging viscous substance and for emptying by manual pumping, the device comprising:

- an elastically deformable outer container of generally cylindrical shape, having an open first end with a shoulder in the form of a truncated cone and a neck suitable for receiving a closure cap, and having a second end that is suitable for being sealed; and
- a flexible inner pouch of generally cylindrical shape, having a closed first end and an open second end;

said pouch being fastened inside said outer container along an annular fastening line placed in such a position that, at the end of the device being emptied, said closed first end bears against said shoulder;

the device being characterized in that:

- between said annular fastening line and its open second end, said pouch constitutes a skirt that is held solely by the annular fastening line and that covers an annular zone on the inside of the outer container;
- in the annular zone covered by said skirt, the outer container presents a series of air-admission orifices for admitting air into the inside of the outer container; and
- said skirt constitutes a valve ensuring that said series of orifices is closed in the event of manual squeezing being applied on the outer container.

Advantageously, the orifices of said series are distributed regularly within said annular zone of the outer container that is covered by said skirt.

Advantageously, the orifices of said series are grouped together in a limited region of said annular zone.

Preferably, the orifices of said series have a diameter of less than 0.1 millimeters (mm).

In an embodiment, said series comprises only one orifice.

The invention also provides a method of preparing a device for packaging viscous substance and for emptying by manual pumping, said device comprising;

- an elastically deformable outer container of generally cylindrical shape having an open first end including a shoulder in the form of a truncated cone and a neck suitable for receiving a closure cap, and a second end that is open; and
- a flexible pouch of generally cylindrical shape with a closed first end and an open second end;

the method being characterized by the following steps:

a) forming air-admission orifices in an annular zone of the outer container;

b) inserting the pouch inside the outer container and pressing it against the outer container, the closed first end of the pouch pressing against the shoulder of the outer container, and the open second end of the pouch being situated between said annular zone and said second end of the outer container; and c) fastening the pouch to the outer container along a fastening line situated between said annular zone and said first end of the outer container.

Advantageously, step c) is performed by welding together the pouch and the outer container from the inside.

Advantageously, the method includes the subsequent steps of:

d) pushing the first end of the pouch as far away as possible from the first end of the outer container;

e) closing the second end of the outer container by sealing;

f) filling the device with viscous substance via the opening at the first end of the outer container by means of a nozzle; and g) applying a closure cap to the neck.

Preferably, step d) is performed by blowing.

Advantageously, the steps d) to g) are executed in the order d), f), e), g).

Advantageously, step d) is not executed and the other subsequent steps are executed in the order f), e), g).

Advantageously, step e) is replaced by a step of:

h) closing the second end of the outer container with a plug.

Other characteristics, details, and advantages of the invention appear from the following description of an embodiment given by way of non-limiting illustration and with reference to the accompanying drawing, in which.

Figure 1:
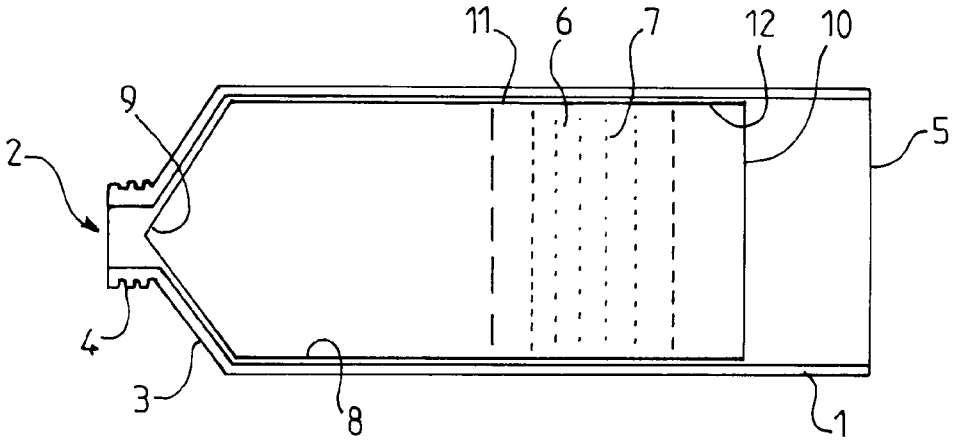
FIG. 1 is an axial section view of an embodiment of the device for packaging viscous substance with the pouch fastened in the outer container.

FIG. 1 shows the outer container 1 of the device for packaging viscous substance. The container 1 is generally cylindrical in shape with an open first end 2 having a shoulder 3 in the form of a truncated cone and a neck 4 suitable for receiving a closure cap. The container 1 has a second end 5 that is open.

In an annular zone 6, the outer container 1 has air-admission orifices 7.

A flexible pouch 8 is arranged inside the outer container 1, the pouch being generally cylindrical in shape, having a first end 9 that is closed and a second end 10 that is open. When the pouch 8 is inserted in the outer container 1, with its closed first end 9 placed against the shoulder 3 of the outer container 1, the open second end 10 of the pouch 8 is situated between the second end 5 of the outer container 1 and the annular zone 6 that is completely covered by the pouch 8, inside the outer container 1.

A fastening line 11 between the pouch 8 and the outer container 1 is arranged between the annular zone 6 and the first end 2 of the outer container 1.

This fastening line 11 is made by welding, for example. Beyond the fastening line 11, between the fastening line 11 and the open second end 10, the pouch 8 constitutes a skirt 12 that is held solely by the fastening line 11 and that covers the annular zone 6.

The device is then ready for filling.

Figure 2:
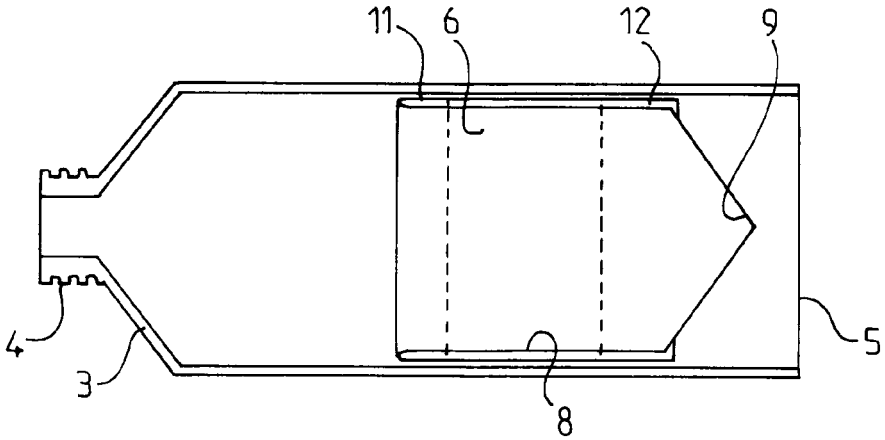
FIG. 2 is an axial section view of the FIG. 1 device after the pouch has been blown or filled.
Figure 3:
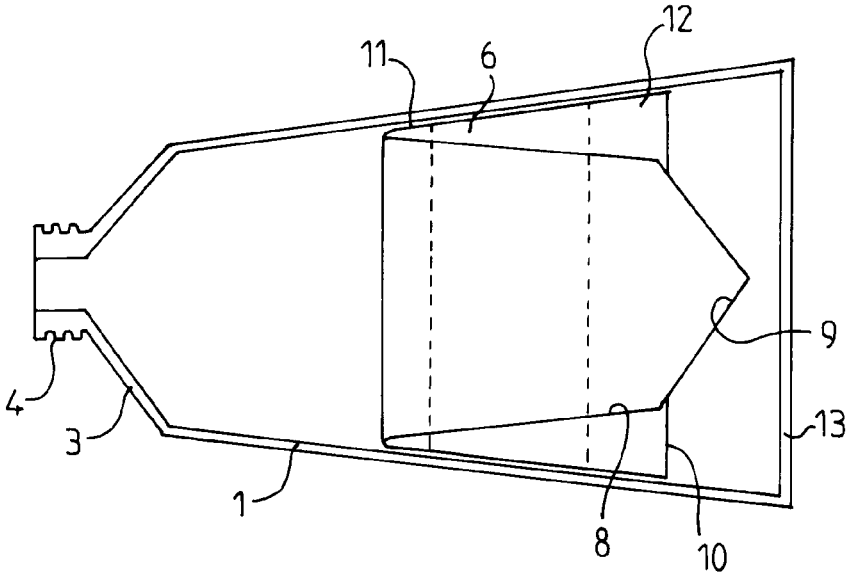
FIG. 3 is an axial section view of the FIG. 2 device after the outer container has been closed.

After the pouch 8 has been pushed away towards the open second end 5 of the outer container 1 (FIG. 2), the second end 5 is closed by pinching and sealing (FIG. 3), along a sealing strip 13 in the embodiment shown.

The packaging device can then be filled, e.g. by means of a nozzle inserted in the open first end 2 of the outer container 1. After filling, a closure cap is fastened on the neck 4 and the device is ready for use.

In order to deliver a quantity of viscous substance, and after removing the cap, it suffices for the operator to apply manual squeezing against the outer container.

The skirt 12 then acts as an annular valve and closes all of the orifices 7 in the annular zone 6. The manual squeezing on the outer container 1 is transmitted to the pouch 8 which turns inside out while accompanying the viscous substance towards the open first end 2 of the outer container 1. Once the desired quantity of substance has been obtained, the operator releases pressure on the outer container 1 and recloses the cap.

If manual squeezing is not sufficient, the operator applies it again, with the valve performing its function. The manual squeezing can be thought of as a manual pumping operation.

The elastically deformable outer container 1 returns to its initial shape since the skirt 12 does not oppose the admission of air through the orifices 7.

In contrast, the skirt 12 opposes the discharge of air through the orifices 7. Thus, in the event of the device not being closed, if outside air tends to enter into the device through the first end 2, the increase in the volume of the pouch causes the skirt 12 to close the orifices 7 and stop air being admitted through the first end 2.

In the annular zone 6, the orifices 7 may be very numerous and of diameter that is very small, preferably less than 0.1 mm.

The orifices 7 may be circular or oblong in shape, they may be constituted by simple slots or by cross-shaped slots, they may be made by incomplete cutting of a patch of the outer container 1. The smaller the orifices, the smaller the risk of the pouch being polluted, the more any vulnerability of the packaging device is reduced, and the better its appearance.

The orifices 7 may be regularly distributed over the entire annular zone 6 or they may be grouped together in a limited region of said zone. The appearance of the orifices 7 in an annular zone 6 makes it possible to avoid few constraints that exist in prior art devices having a single orifice for closing with a finger of the operator: there is no longer the constraint of where the orifice should be positioned on the outer container and there is no longer the constraint of placing the finger on the orifice.

In the invention, the manual squeezing on the outer container may be exerted equally well at any point.

Providing orifices of small diameter greatly reduces any risk of sand or grains penetrating through the orifices into the outer container 2 and damaging the pouch 8. This protects the integrity of the packaging device. Nevertheless, it should be observed that the shape and the number of the orifices do not constitute a condition for enabling the packaging device to operate, and that the skirt 12 acts as a valve even if the annular zone has only one orifice and regardless of the shape of the orifice.

One of the advantages of the invention is that using a portion of the pouch 8 as an annular valve, and specifically using the skirt 12 of the pouch, serves firstly to place a valve in the outer container 1 merely by the operation of fastening the pouch 8, and serves secondly to avoid any need to use a separate valve.

Another advantage of the invention is to be able to select the amount of substance the packaging device can contain independently of its size. The fastener line 11 between the pouch 8 and the outer container 1 may be moved closer to the shoulder 3 in order to reduce the substance content of the device, e.g. for issuing samples, for demonstrations, or for promotional sales.

The method of using the device for packaging viscous substance that is emptied by manual pumping is conducted using the following steps:

a) Forming air-admission orifices 7 in an annular zone 6 of the elastically deformable outer container 1 that is generally cylindrical in shape, the container having an open first end 2 with a shoulder 3 in the form of a truncated cone and a neck 4 suitable for receiving a closure cap, and having a second end zone 5 that is open.

b) Inserting into the outer container 1 a flexible pouch 8 having a closed first end 9 and an open second end 10, the pouch being inserted by placing the closed first end 9 to press against the shoulder 3, with the open second end 10 being situated between the annular zone 6 and the open second end 5 of the outer container 1.

c) Fastening the pouch 8 to the outer container 1 along the fastening line 11 situated between the annular zone 6 and the first end 2 of the outer container 1. This fastening is advantageously performed by welding from the inside of the pouch 8 and of the outer container 1.

At this stage, several procedures are possible. In the first procedure, the method continues with the following steps:

d) Pushing the first end 9 of the pouch 8 as far away as possible from the first end 2 of the outer container. This operation is advantageously performed by blowing from the first end 2 of the outer container.

e) Closing the second end 5 of the outer container by pinching and sealing.

f) Filling the device with viscous substance through the opening of the first end 2 of the outer container 1, e.g. by means of a nozzle.

g) Applying a closure cap to the neck 4.

The packaging device is then ready for use.

In a second procedure, the method continues by performing the steps in the order d), f), e), and g).

This second procedure is particularly adapted to the situation in which the device is delivered empty and is then filled with substance from a batch that needs to be identified. At the end of filling, this identification can be provided during the operation of closing the second 5 of the outer container by pinching, by writing the batch number of the substance on the sealing strip of the device.

In a third procedure, the method continues by performing the steps f), e), and g) in succession. In the above procedures in which the pouch 8 is pushed into the outer container 1, the filling of the pouch by means of a nozzle requires air to escape from the pouch progressively during filling. The nozzle must then be sufficiently narrow to avoid the closing the end opening 2. As a result its substance feed channel is also narrow and the operation of filling the pouch is relatively lengthy.

In this third procedure, the filling operation may be performed simultaneously with the step of pushing the pouch into the container by using the pressure of the substance being inserted. Under such circumstances, it can happen that the filler nozzle can be brought directly into contact with the neck 4 of the outer container without any need to allow air to escape. Thus, the rate and hence the speed of filling are maximized. This leads to an additional advantage. Since no air penetrates into the pouch, it is possible to make provision for processing to be aseptic. Steps a) to c) may be performed in an aseptic atmosphere and immediate filling can ensure health safety. If filling is not immediate, the opening of the second end 2 of the outer container 1 may be closed by a capsule and the device may be delivered empty and subsequently opened and filled under an aseptic atmosphere.

In the above-described second and third procedures, the device is delivered with the second end 5 of the outer container 1 open.

The second end 5 of the outer container is preferably closed by pinching and sealing. However this closing may also be performed by a cylindrical plug that is inserted into the open end 5 and then heat-sealed thereto or adhesively-bonded thereto, for example. Such a cylindrical plug may provide a stable base to enable the device to stand vertically, regardless of the shape of its cap.

In the context of the present invention, the pouch 8 performs two functions: firstly it constitutes a deformable pouch for containing the viscous substance without coming into contact with air, and secondly it constitutes a skirt acting as an annular valve for ensuring that manual pumping is effective on the device for packaging the viscous substance.

In an advantageous provision, the closed first end 9 of the pouch is conically shaped, having the same cone angle as the truncated cone of the shoulder 3, thereby enabling the device to be emptied completely.

One particular embodiment of the invention is described above, but the invention covers any technical equivalent.

The invention claimed is:

1. A device for packaging viscous substance and for emptying by manual pumping, the device comprising:

an elastically deformable outer container of generally cylindrical shape, having an open first end with a shoulder in the form of a truncated cone and a neck suitable for receiving a closure cap, and having a second end that is suitable for being sealed; and a flexible inner pouch of generally cylindrical shape, having a closed first end and an open second end; said pouch being fastened inside said outer container along an annular fastening line placed in such a position that, at the end of the device being emptied, said closed first end bears against said shoulder;

wherein between said annular fastening line and its open second end, said pouch constitutes a skirt that is held solely by the annular fastening line and that covers an annular zone on the inside of the outer container; in the annular zone covered by said skirt, the outer container presents a series of air-admission orifices for admitting air into the inside of the outer container; and said skirt constitutes a valve ensuring that said series of orifices is closed in the event of manual squeezing being applied on the outer container.

2. A packaging device according to claim 1, wherein the orifices of said series have a diameter of less than 0.1 mm.

3. A method of preparing a device for packaging viscous substance and for emptying by manual pumping, said device having; an elastically deformable outer container of generally cylindrical shape having an open first end including a shoulder in the form of a truncated cone and a neck suitable for receiving a closure cap, and a second end that is open; and a flexible pouch of generally cylindrical shape with a closed first end and an open second end; said method comprising the steps of:

a) forming air-admission orifices in an annular zone of the outer container;

b) inserting the pouch inside the outer container and pressing it against the outer container, the closed first end of the pouch pressing against the shoulder of the outer container, and the open second end of the pouch being situated between said annular zone and said second end of the outer container; and c) fastening the pouch to the outer container along a fastening line situated between said annular zone and said first end of the outer container.

4. A method according to claim 3, wherein step c) is performed by welding together the pouch and the outer container from the inside.

5. A method according to claim 3, further comprising the steps of:

d) pushing the first end of the pouch as far away as possible from the first end of the outer container;

e) closing the second end of the outer container by sealing;

f) filling the device with viscous substance via the opening at the first end of the outer container by means of a nozzle; and g) applying a closure cap to the neck.

6. A method according to claim 5, wherein step d) is performed by forcing air into said pouch from the first end of the outer container.

7. A method according to claim 5, wherein step e) is replaced by the following step: h) closing the second end of the outer container with a plug.

8. A method according to claim 3, further comprising the steps of:

d) pushing the first end of the pouch as far away as possible from the first end of the outer container;

e) filling the device with viscous substance through the opening at the first end of the outer container;

f) closing the second end of the outer container by sealing; and g) applying a closure cap to the neck.

9. A method according to claim 8, wherein step e) is replaced by the following step: h) closing the second end of the outer container with a plug.

10. A method according to claim 3, further comprising the steps of:

e) filling the device with viscous substance through the opening at the first end of the outer container;

f) closing the second end of the outer container by sealing; and g) applying a closure cap to the neck.

11. A method according to claim 10, wherein step e) is replaced by the following step: h) closing the second end of the outer container with a plug.

* * * * *